US005984547A

United States Patent [19]

Kitamura et al.

[11] Patent Number: 5,984,547

[45] Date of Patent: Nov. 16, 1999

[54] STEAMLESS INK RIBBON AND MANUFACTURE THEREOF

[75] Inventors: Yoshiro Kitamura, Kanazawa; Masami Shini; Zheng long Cai, both of Osaka, all of Japan

[73] Assignees: Kitamura Mfg., Co., Ltd., Ishikawa, Japan; Fujicopian Co., Ltd., Osaka, Japan

[21] Appl. No.: 09/083,384

[22] Filed: May 22, 1998

[30] Foreign Application Priority Data

May 27, 1997 [JP] Japan ..... 9-136946
Apr. 27, 1998 [JP] Japan ..... 10-116483

[51] Int. Cl.[6] ..... B41J 31/09

[52] U.S. Cl. ..... 400/241; 400/241.3

[58] Field of Search ..... 400/241, 241.3, 400/240.4, 238

[56] References Cited

U.S. PATENT DOCUMENTS

| | | | |
|---|---|---|---|
| 2,918,160 | 12/1959 | Thompson | 400/241.3 |
| 5,380,107 | 1/1995 | Hiroe et al. | 400/241 |
| 5,387,300 | 2/1995 | Kitamura | 156/148 |

FOREIGN PATENT DOCUMENTS

| | | | |
|---|---|---|---|
| 0098382 | 6/1982 | Japan | 400/241.1 |
| 61-284476 | 12/1986 | Japan | 400/241.3 |
| 1-26349 | 5/1989 | Japan . | |
| 403079380 | 4/1991 | Japan | 400/241.3 |

*Primary Examiner*—Edgar Burr
*Assistant Examiner*—Anthony H. Nguyen
*Attorney, Agent, or Firm*—Armstrong, Westerman, Hattori, McLeLand & Naughton

[57] ABSTRACT

An object of the invention is to provide a seamless ink ribbon which makes it possible to markedly prolong the printing life, even with rather rough-faced printing paper such as paper made in China as well as a method of manufacturing the same.

The seamless ink ribbon of the invention comprises a statically hot-pressed seamless woven fabric with multifilament yarn as warp and as weft. This ribbon is manufactured by subjecting a seamless woven fabric obtained by double weaving using multifilament yarn as warp and as weft to static hot pressing, without applying any shearing force, to thereby reduce the thickness of the fabric by 15 to 50% as compared with the thickness before pressing. The seamless fabric is fuse-cut to the ribbon width either before or after hot pressing.

2 Claims, 3 Drawing Sheets

STEAMLESS INK RIBBON AND MANUFACTURE THEREOF

FIELD OF THE INVENTION

The present invention relates to a seamless ink ribbon for impact printing which features a remarkably extended useful life even when used with rather rough-surfaced paper such as the paper produced in China and to a method of manufacturing the same. In the present specification, the term "ink ribbon" is used to indicate a "ribbon for printing", irrespective of whether it has been inked or not yet inked.

BACKGROUND OF THE INVENTION

Ink-saturated endless ribbons are widely used as unicolor or multicolor ink ribbons for wire dot printers of computers, word processors or like devices. Such endless ribbons are manufactured by producing a plain-woven fabric using nylon or polyester multifilament yarn as warp and as weft, cutting said plain-woven fabric to a predetermined width so that the direction of warp coincides with the longitudinal direction of the ribbon, and joining both ends with each other to make the ribbons endless.

Those seamless ribbons are also known which are manufactured by producing a tubular, jointless (namely seamless) plain-woven fabric by double or tubular weaving and then fuse-cutting the same in the radial direction. In this case, contrary to the above-mentioned case of obtaining endless ribbons from plain-woven fabrics, the direction of weft of the fabric becomes the longitudinal direction (circumferential direction) of the ribbon. Seamless ribbons are advantageous just because, unlike endless ribbons, they have no junction. The present invention is concerned with ribbons of this kind, namely seamless ribbons.

In manufacturing such seamless ribbons, nylon or polyester multifilament yarn is generally used as warp and weft.

When 40d/34f multifilament yarn is used for weaving, the mean yarn density is selected as shown below in Table 1, for instance. Typical of those shown are quasi-high density products with a warp density of 146 yarns/inch, a weft density of 148 yarns/inch and a total density of 294 yarns/inch.

TABLE 1

| | Warp density A (yarns/inch) | Weft density B (yarns/inch) | A + B (yarns/inch) |
|---|---|---|---|
| Ordinary density product | 132 | 142 | 274 |
| Quasi-high density product | 146 | 148 | 294 |
| High density product | 180 | 150 | 330 |
| Very high density product | 180 | 162 | 342 |

As regards the ribbon width, unicolor ribbons are relatively narrow and, as the number of colors increases, the width is increased accordingly. The circumferential ribbon length may be selected arbitrarily, although the upper limit to the ink ribbon circumferential length is by itself defined when the ribbons are intended to be loaded into standardized cassettes.

When the ink ribbon contained in a cassette, while making a round, arrives at the head, it is struck by the printer needle and the ink in the remaining part diffuses to resume homogeneity. When compact cassettes are used, ink ribbons are accommodated as folded in a zigzag fashion.

In impact printing, a platen, paper, a perforated mask, a ink ribbon and a head are arranged in that order, a dot printer needle protruding from the head is thrust against the ink ribbon to thereby strike the ink ribbon, through holes of the mask, against the paper, the shock being absorbed by the platen.

For information, Japanese Patent Publication H01-26349 (Kokai Tokkyo Koho S57-93187) discloses a method of manufacturing ink ribbon base cloths which comprises reducing, by 2 to 10%, the thickness, after scouring and setting, of a high density woven fabric composed of 20 to 120 denier synthetic fiber multifilament yarns as warp and weft and having a warp density of 150 to 220 yarns/inch and a weft density of 100 to 140 yarns/inch by pressing under heating, without rendering the same film-like, to render the same apparently reed mark-free. The thickness reduction is effected by conducting the pressing under heating using a heating and pressing means comprising two or more rolls and driving at least two rolls of the heating and pressing means at different speeds at a ratio in number of revolutions within the range of 1:1.1 to 1:2.0.

Seamless ink ribbons are not only used in Japan but also exported to and used in various other countries. In some countries, however, the paper on which printing is to be made, for example the paper produced in China, sometimes has a rough surface. (An investigation on the quality of paper produced in China revealed that the surface roughness is high both lengthwise and breadthwise, the ash content is high, and the content of kaolin type substances other than talc is high, thus making the surface hard). In Japan as well, the consumption of such rough-surfaced paper as regenerated or recycled paper is increasing from the viewpoint of resources saving.

When rough-surfaced paper is used, the ink ribbon accommodated in a cassette, running for printing, comes into contact with the paper and is rubbed by it so that the wear of the ink ribbon is more significant as compared with the case of standard printing paper. In other words, the rough paper plays the role of sandpaper, causing the wear of the ink ribbon. Therefore, when such rough-surfaced paper as the paper produced in China is used, the printable number of characters (i.e. the number of impressions) per ink ribbon is markedly reduced as compared with the case of quality paper, even when the ink ribbon itself still contains a considerable amount of ink.

Accordingly, it is an object of the present invention to provide a seamless ink ribbon showing a long life in printing even with rough-surfaced paper such as the paper produced in China as well as a method of manufacturing the same.

It is to be added that the reason why an attempt is made to eliminate reed marks from the high density woven fabric in the invention disclosed in Japanese Patent Publication H01-26349 as referred to above is that while a plurality of warps are drawn into each reed wire in manufacturing a flat woven fabric according to a conventional method of weaving, the so-called reed marks, namely interyarn gaps, are produced, when the warp density is high, in the warp direction (when in the ribbon form, in the longitudinal direction) at those portions of the woven fabric which correspond to the reed wires. Thus, the invention in said publication is based on the premise that it is concerned with a process for manufacturing ribbon base cloths by obtaining a flat woven fabric, cutting the same to a predetermined width with the warp direction being taken as the longitudinal direction of ribbons, and joining both ends together to give endless ribbons. When the warp density is increased, the occurrence of reed marks becomes unnegligible and it becomes a problem to eliminate them. Therefore, according to the invention in said publication, the thickness is reduced by 2 to 10% as compared with the original thickness to attain apparent absence of reed marks by means of two rolls driven at different circumferential speeds. The extent of thickness reduction is said to have a limit since when the thickness reduction exceeds 10%, the appearance becomes flat and film-like and the ink absorptivity becomes poor.

On the contrary, the present invention is concerned with a seamless ribbon. In contrast with the case where endless ribbons are obtained from a flat woven fabric, as mentioned above referring to the publication cited above, the weft direction becomes the longitudinal direction of the ribbon (circumferential direction) in the present invention, so that it is no more necessary to join both ends together and there is no reed mark problem, either. In other words, in the case of endless ribbons, warps run in the circumferential direction just like a railroad track and therefore, when there is a lack of uniformity (reed mark) in the track width, even blows of a dot printer can hardly make the track width uniform. In the case of seamless ribbons, the warps in the process of weaving are disposed, with a short length, in the direction of ribbon width, just like railroad ties and, even when ties are disposed at more or less irregular intervals, there is little influence on the quality of printing in the initial stage of use when the quantity of ink is abundant and, in addition, the first one or two blows of a dot printer automatically correct the irregularity in tie intervals. Thus, the decrease in ink quantity will not cause any substantial irregularities in the quality of printing.

SUMMARY OF THE INVENTION

The present invention provides a seamless ink ribbon which comprises a statically hot-pressed seamless woven fabric made up of multifilament yarn for both warp and weft and reduced in thickness by 15 to 50% as compared with the original thickness as a result of static hot pressing without shearing force application.

The present invention further provides a method of manufacturing a seamless ink ribbon which comprises subjecting a seamless woven fabric having a plain weave structure as obtained by double weaving using multifilament yarn as warp and as weft to static hot pressing, without applying any shearing force, to reduce the thickness of the fabric by 15 to 50% as compared with the thickness before pressing, said seamless fabric being fuse-cut to the ribbon width either before or after said hot pressing.

Figure 1:
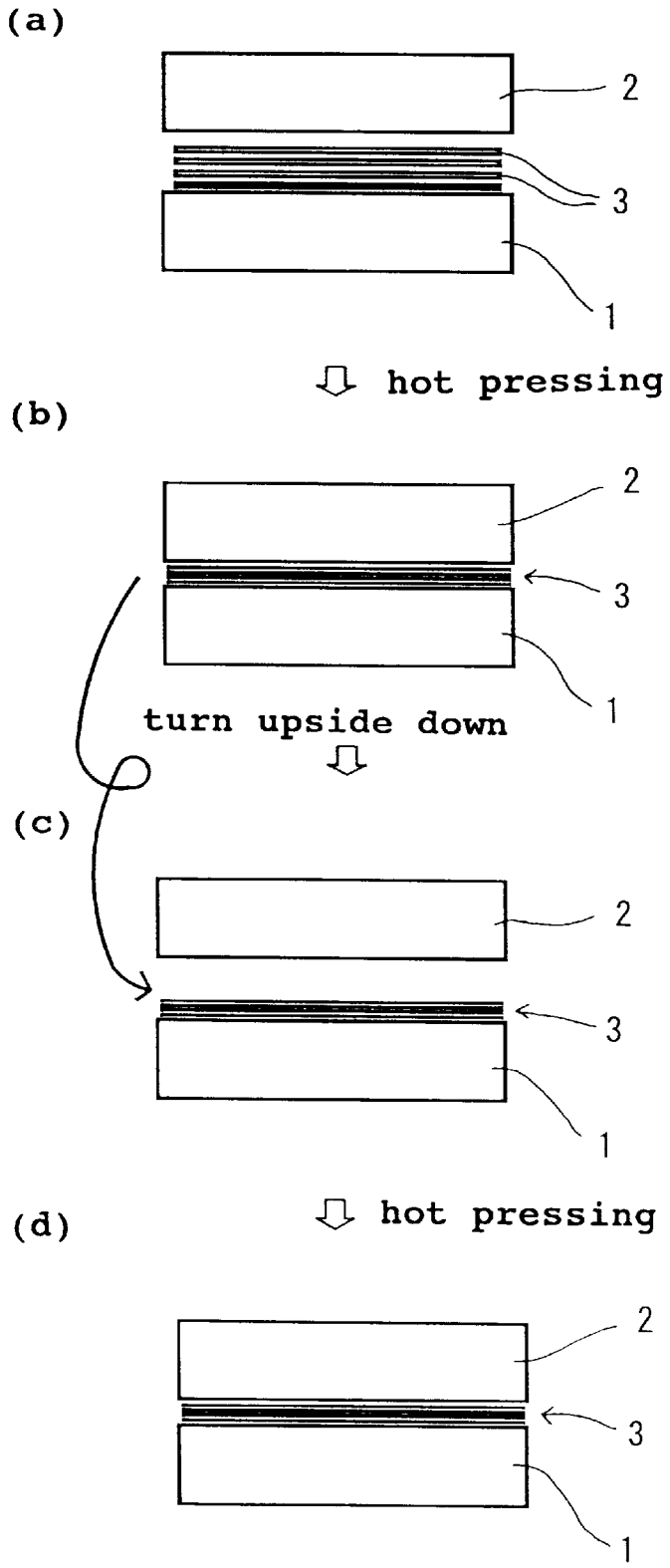
FIG. 1 is a schematic representation of an embodiment of the process for manufacturing seamless ink ribbons according to the present invention.

In the figures, the numeral 1 denotes a bottom plate of a press, 2 denotes a top plate of the press, and 3 denotes a seamless woven fabric.

DETAILED DESCRIPTION OF THE INVENTION

In the ink ribbon of the present invention, multifilament yarn is used for both the warp and weft which constitute the ink ribbon structure. Nylon (e.g. nylon 66 or nylon 6) is a preferred material. Polyesters may also be used.

The warp and weft which can be used include those in conventional use, typically 40d/34f, 30d/26f and 30d/12f, and others varying in thickness and filament number. As well known in the art, d (denier) is the number of grams of the yarn per 9,000 m and f is the number of filaments per multifilament yarn.

A tubular seamless woven fabric can be obtained by carrying out double weaving using the above-mentioned multifilament yarn as warp and weft. After weaving, the fabric may be subjected to post-treatment, such as scouring, heat setting and/or the like, as necessary. The term "double or tubular weaving" as used herein means a technique for weaving a fabric composed of two overlapping webs connected with each other at both ends only during the reciprocating movement of weft. A plain-weave structure is generally employed as the weave structure. It is also possible to employ a twill-weave or satin-weave structure, or a derivative weave, as the case may be.

As regards the mean yarn density to be employed in weaving, a quasi-high density is desirable when 40d/34f multifilament yarn, for instance, is used. In that case, the warp density is about 146 yarns/inch, the weft density is about 148 yarns/inch, and the total density is about 294 yarns/inch. It is, however, possible to select various warp and weft densities; not only quasi-high density but also ordinary density, high density, very high density, etc.

In accordance with the present invention, the thus-obtained seamless woven fabric is statically hot-pressed, without applying a shearing force, to reduce the thickness thereof by not less than 15%, preferably by not less than 17%, more preferably by not less than 20%, as compared with the thickness before pressing. The upper limit of thickness reduction is 50%, preferably 40%, more preferably 35%. When the thickness reduction is below 15%, any significant improvement in printing service life cannot be expected. Conversely, such excessive hot pressing as to cause a thickness reduction exceeding 50% may damage the fabric itself or make it difficult for the fabric to be saturated with ink. The term "thickness" as used herein means the mean thickness obtained by taking thickness measurements at a number of points in the radal direction of the seamless woven fabric using a thickness gauge.

Hot pressing without shearing force application is preferably carried out using a flat hot press.

Typically, hot pressing on that occasion is desirably carried out in the following manner (cf. FIG. 1). A tubular, seamless woven fabric cut to a width suited for the treatment on a press or an appropriate number (two or more) of such woven fabrics laid one on top of another, each in a flattened state, are placed on the bottom plate of the press and pressed while applying heat to the top and bottom plates of the press. Then, the press is loosened, the seamless woven fabric or overlapping seamless woven fabrics are turned upside down and hot pressing is performed once again in the same manner. In this case, it is desirable that both selvage portions of the flattened seamless woven fabric or fabrics as resulting from weaving are not placed on the edge portions of the bottom plate but more or less in the vicinity of the middle thereof. A ground paper or board may be inserted into the flattened-state tubular seamless woven fabric to be subjected to pressing.

Hot pressing may also be performed in the following manner (cf. FIG. 3). A seamless woven fabric cut to an appropriate width or an appropriate number (two or more) of such woven fabrics laid one on top of another, each in a flattened state, are placed on the bottom plate of the press and pressed from above by means of the hot plate and then, after shifting the edges, in the first pressing, of the seamless woven fabric or fabrics to places more or less in the vicinity of the middle of the press, pressing is again performed by means of the hot plate. This procedure is repeated once or several times. A ground paper or board may be inserted into the flattened-state tubular seamless woven fabric to be subjected to pressing.

Hot pressing may further be carried out in the following manner (cf. FIG. 2). A seamless woven fabric cut to an appropriate width is mounted on the press in a manner such that said fabric wraps the bottom plate of the press, followed by pressing from above by means of the hot plate. Then, after shifting the seamless woven fabric after the first pressing in the radial direction, pressing is again performed by means of the hot plate. This procedure is repeated once or several times until said woven fabric has been pressed throughout. In this case, the bottom plate need not be heated but may be heated to an appropriate temperature.

In each of the methods of hot pressing mentioned above by way of example, it is preferred, from the viewpoint of rapidity and uniformity of heating, that the top plate or the top and bottom plates of the press should be heated by means of steam or electric heating plates. The pressing procedure is mostly performed hydraulically.

It is important that no shearing force is exerted on the occasion of hot pressing. The method which comprises putting a seamless woven fabric or fabrics between the upper and lower rolls and performing hot pressing by rotating the rolls should be avoided since a shearing force is exerted on the seamless woven fabric or fabrics, causing texture disturbance, wrinkling, etc.

Before or after hot pressing, setting may be performed as necessary to stabilize the circumferential length. Then, the woven fabrics are fuse-cut to a ribbon width, whereby seamless ribbons with a monolayer structure are obtained. Setting and/or fuse-cutting may be performed prior to the hot pressing procedure as well.

The circumferential length of the ribbon depends on the ribbon-containing space within the cassette. Generally, cassettes meeting a specific specification are used and, therefore, a circumferential length is selected which is as long as possible within the limits of loading into the space. Even when seamless ribbons identical in yarn density with the conventional ones are used, they are reduced in ribbon thickness by pressing in accordance with the present invention and therefore ribbons with a longer circumferential length can be loaded into cassettes.

Inking of the ribbons having the above constitution gives product ink ribbons. The color of ink can be chosen arbitrarily. In the case of multicolor ink ribbons, two colors, black and red, or a total of four colors, black, cyan, magenta and yellow, are employed in most cases. In producing multicolor ink ribbons, a borderline or borderlines are formed in advance in the lengthwise direction and the borderline-defined regions or lanes are saturated with the respective color inks.

The seamless ink ribbons of the present invention are useful as ink ribbons for printers belonging to computers, word processors and the like.

In accordance with the present invention, a special measure is taken which comprises subjecting a seamless woven fabric obtained by double weaving using multifilament yarn as warp and as weft to static hot pressing, without applying any shearing force, to thereby reduce the thickness of the fabric by 15 to 50% as compared with the thickness before pressing. In other words, a contrivance is made so that the thickness alone can be greatly reduced without altering the weave density. Common sense may tell that generally, the thinner the ink ribbon is, the weaker, hence the shorter in life, it is. In accordance with the present invention, however, the weave density remains unchanged and therefore the strength is retained in spite of the reduced ink ribbon thickness.

Since the seamless ink ribbon of the present invention has a greatly reduced thickness (and a smoothed surface as well) while retaining the strength, it can be loaded, with a longer circumferential length, into the limited cassette space. Owing to the reduced thickness (and improved surface condition) coupled with the increased circumferential length, the contact between the ink ribbon surface and paper can be reduced. As a result, even when rough-surfaced paper such as paper made in China is used, the printing capacity of the ribbon can be increased about 1.3 to 1.8 times as compared with the conventional seamless ink ribbons having the same yarn density. When ordinary paper is used, the printing capacity can be increased as compared with the conventional ink ribbons as well.

Further, since the static hot pressing technique is employed in accordance with the present invention, no shearing force is exerted, unlike the case of hot pressing while rotating rolls, hence no texture disturbance or wrinkling will occur.

In addition, while seamless woven fabrics inevitably have both selvage regions somewhat thicker than the remaining regions as resulting from weaving, the static hot pressing according to the present invention markedly reduces the difference in thickness between the selvage portions resulting from weaving and the remaining regions, whereby a uniform thickness is attained around the whole circumference of the ribbon, giving a further advantage in that the ribbon running and/or printing operation becomes smoother.

Thus, the present invention produces an unexpected favorable effect in that the printing life of the ink ribbon can be much prolonged while using a less thick ink ribbon.

EXAMPLES

The following examples are further illustrative of the present invention.

Manufacture of Seamless Ribbons

Examples 1, 2, 4 and 5

FIG. 1 is a schematic representation of an embodiment of the process for manufacturing seamless ink ribbons according to the present invention.

Using 40d/34f nylon 66 multifilament yarn (referred to as "N40d" below in Tables 2 and 3) for warp and weft, a seamless woven fabric 3 having a plain weave structure with a circumferential length of 1,600 mm (for use in Examples 1 and 4) or a 2,200 mm (for use in Examples 2 and 5) was produced by the double weaving technique and, after scouring, subjected to wet heat setting.

The tubular seamless woven fabric 3, in a flattened state, was cut to a width suited for treatment on the press. A predetermined number of the thus-cut seamless woven fabric pieces are placed, in a piled-up state, on the bottom plate 1 of the press (see a in FIG. 1) and subjected to hydraulic pressing in a static state while heating both the bottom plate 1 and top plate 2 by means of an electric heating plate system (see b in FIG. 1). Then, the press was once loosened, the piled-up seamless woven fabric pieces 3 were turned upside down (see c in FIG. 1) and hot pressing was again carried out in the same manner (see d in FIG. 1).

The seamless woven fabric pieces 3 thus reduced in thickness were suspended between rolls and fuse-cut to the ribbon width by means of a hot cutting part, to give seamless ribbons with a unilayer structure.

Example 3

Figure 2:
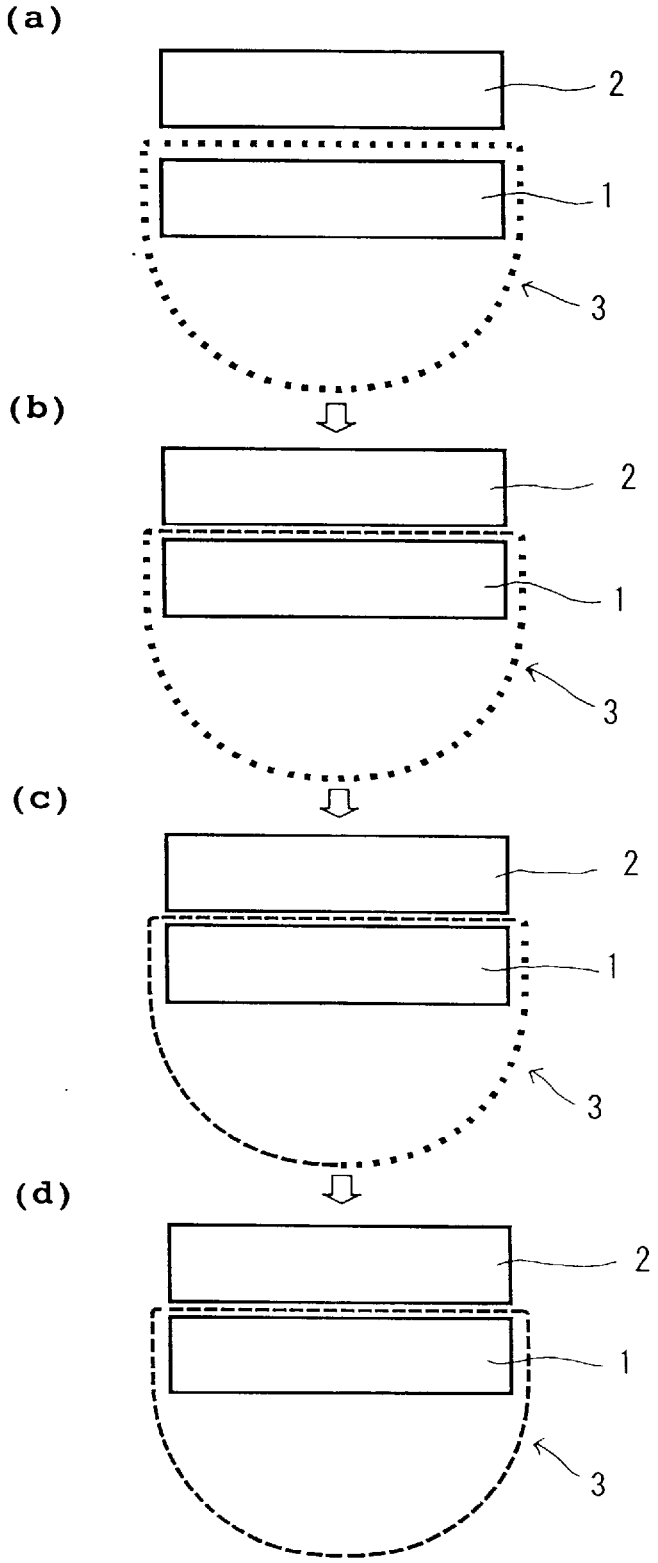
FIG. 2 is a schematic representation of another embodiment of the process for manufacturing seamless ink ribbons according to the present invention.

FIG. 2 is a schematic representation of another embodiment of the process for manufacturing seamless ink ribbons according to the present invention. In the figure, the dotted line denotes the portion of a ribbon which is not yet hot-pressed and the broken line denotes the portion of which has been hot-pressed.

Using 40d/34f nylon 66 multifilament yarn (referred to as "N40d" below in Table 2), a seamless woven fabric 3 having a plain weave structure with a circumferential length of 2,800 mm was produced by the double weaving technique and, after scouring, subjected to wet heat setting.

The procedure of the above examples was followed except that the following hot pressing system was employed. Thus, the tubular seamless woven fabric 3, in a flattened state, was cut to a width suited for treatment on the press and mounted on the press in a manner such that it wrapped the bottom plate 1 (see a in FIG. 2). The top plate 2, steam-heated, was pushed from above against the fabric portion on the bottom plate and hot pressing was carried out in a static state (see b in FIG. 2). The seamless woven fabric 3 was then shifted in the radial direction by about one third of the circumferential length and static hot pressing was performed in the same manner (see c in FIG. 2). Further, the seamless woven fabric 3 was shifted in the radial direction by about one third of the circumferential length and static hot pressing was performed in the same manner (see d in FIG. 2).

The seamless woven fabric piece 3 thus reduced in thickness was suspended between rolls and fuse-cut to the ribbon width by means of a hot cutting part, to give seamless ribbons with a unilayer structure.

Comparative Examples 1 and 2

Seamless ink ribbons were obtained in the same manner as in Examples 1 and 4 except that the hot pressing was omitted.

Performance Testing of Ink Ribbons

The seamless ribbons obtained in Examples 1 to 5 and Comparative Examples 1 and 2 were respectively inked and housed in cassettes. Using two kinds of 24-pin wire dot printer (hereinafter referred to as Pr.A and Pr.B), ultrahigh speed printing was carried out in the draft mode to thereby examine the performance of each ink ribbon. Each thickness value shown is the mean value of measurements taken at 32 sites over the whole circumference on the center line of the ribbon.

The conditions and results are shown in Tables 2 and 3. The ratio shown under the heading "Number of characters that can be printed" is the ratio relative to the data for Comparative Example 1 or 2 (said data being taken as 1.00).

TABLE 2

| | Compar. Ex. 1 | Example 1 | Example 2 | Example 3 |
|---|---|---|---|---|
| Printer | Pr. A | Pr. A | Pr. A | Pr. A |
| Ribbon structure | Unilayer | Unilayer | Unilayer | Unilayer |
| Ribbon width (mm) | 8 | 8 | 8 | 8 |
| Ribbon circumferential length (mm) | 1600 | 1600 | 2200 | 2800 |
| Yarn species | | | | |
| Warp | N40d | N40d | N40d | N40d |
| Weft | N40d | N40d | N40d | N40d |
| Yarn density (yarns/inch) | 146/148 Quasi-high density | 146/148 Quasi-high density | 146/148 Quasi-high density | 146/148 Quasi-high density |
| Ribbon thickness (mm) | 0.120 | 0.092 | 0.090 | 0.085 |
| Hot pressing | No | Yes | Yes | Yes |
| Number of characters that can be printed (ratio) | 8.5 × $10^5$ (1.00) | 8.7 × $10^5$ (1.02) | 12.1 × $10^5$ (1.42) | 13.9 × $10^5$ (1.64) |

TABLE 3

| | Compar. Ex. 2 | Example 4 | Example 5 |
|---|---|---|---|
| Printer | Pr. B | Pr. B | Pr. B |
| Ribbon structure | Unilayer | Unilayer | Unilayer |
| Ribbon width (mm) | 8 | 8 | 8 |
| Ribbon circumferential length (mm) | 1600 | 1600 | 2200 |
| Yarn species | | | |
| Warp | N40d | N40d | N40d |
| Weft | N40d | N40d | N40d |
| Yarn density (yarns/inch) | 146/148 Quasi-high density | 146/148 Quasi-high density | 146/148 Quasi-high density |
| Ribbon thickness (mm) | 0.120 | 0.093 | 0.090 |
| Hot pressing | No | Yes | Yes |
| Number of characters that can be printed (ratio) | 9.1 × $10^5$ (1.00) | 9.3 × $10^5$ (1.02.) | 12.5 × $10^5$ (1.37) |

As can be seen in Tables 2 and 3, comparisons between ink ribbons of identical circumferential length (Comparative Example 1 versus Example 1, Comparative Example 2 versus Example 4) led to the conclusion that the number of characters that can be printed (and the ribbon strength as well) will not decrease even when the thickness is reduced by hot pressing. This means that since when hot pressing is performed, the thickness can be reduced, ribbons longer in circumferential length can be housed in cassettes meeting a certain specification.

It was further revealed that when the circumferential length is increased, the number of characters that can be printed markedly increases, as can be seen in Examples 2 and 3 as well as in Example 5. More detailedly, when comparison is made between Comparative Example 1 and Examples 2 or 3, where the circumferential length is 1,600 mm in Comparative Example 1, 2,200 mm in Example 2 and 2,800 mm in Example 3, the length in Example 2 is 2,200/1,600=1.375 times longer and that in Example 3 2,800/1,600=1.75 times longer while the number of characters that can be printed is 121/85=1.42 times larger in Example 2 and 139/85=1.64 times larger in Example 3. When comparison is made between Comparative Example 2 and Example 5, where the circumferential length is 1,600 mm in Comparative Example 2 and 2,200 mm in Example 5, the length in Example 5 is 2,200/1,600=1.375 times longer while the number of characters that can be printed is 125/91=1.37 times larger in Example 5. It is thus evident that the number of characters that can be printed increases favorably by the increment in circumferential length.

Thickness Irregularity of Ink Ribbons

Example 6

Figure 3:
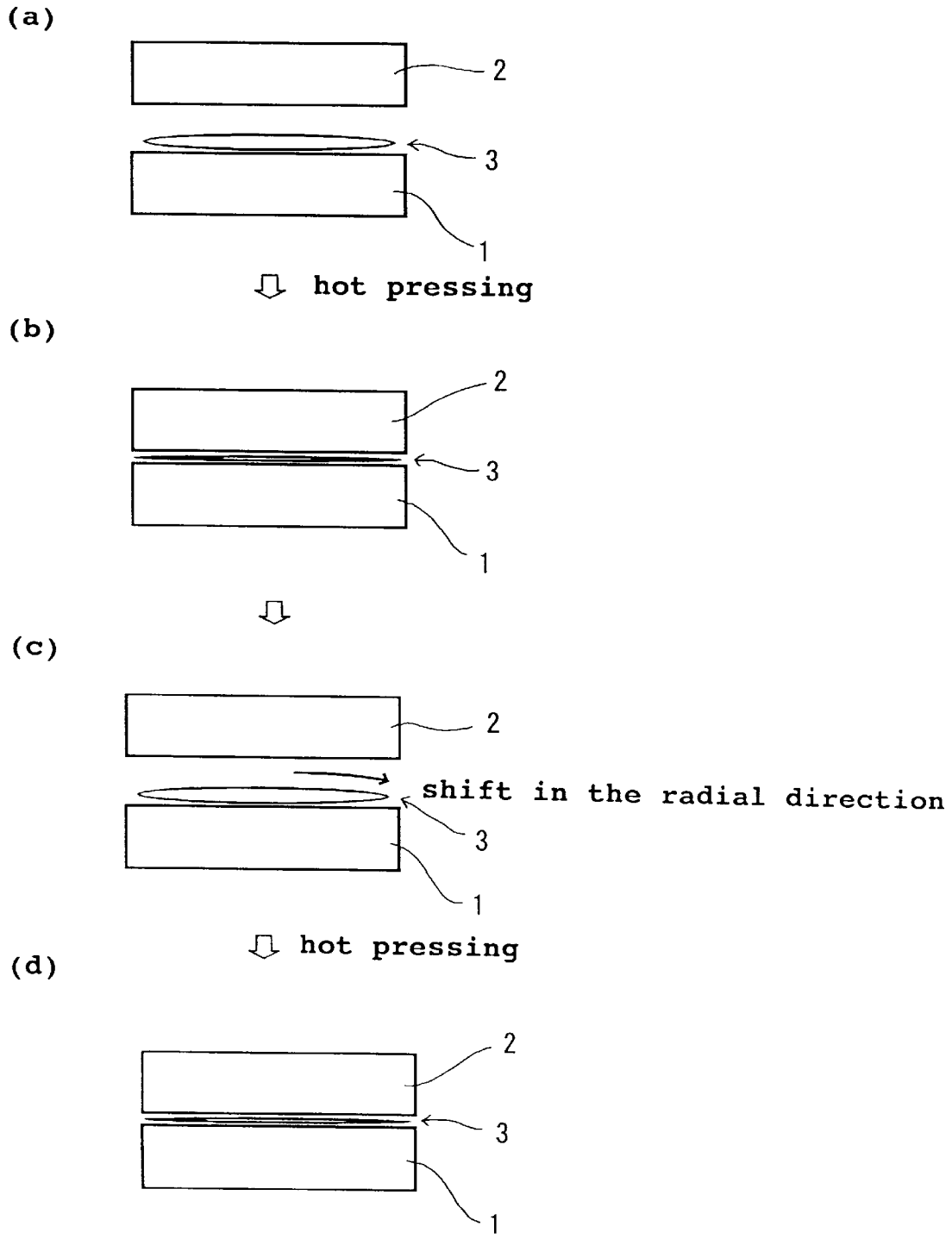
FIG. 3 is a schematic representation of a further embodiment of the process for manufacturing seamless ink ribbons according to the present invention.

FIG. 3 is a schematic representation of a further embodiment of the process for manufacturing seamless ink ribbons according to the present invention.

One of the seamless ink ribbons with a width of 8 mm and a circumferential length of 1,600 mm (with 40d/34f nylon 66 multifilament yarn being used as warp and as weft) currently produced by the applicant was prepared as a standard ribbon (Comparative Example 3).

This seamless ink ribbon was placed on the bottom plate 1 of the press and hot-pressed from above by means of the top plate 2. After the first pressing, the seamless ink ribbon was shifted in the radial direction by half the circumference and again hot-pressed.

The thus-obtained, hot-pressed seamless ink ribbon was subjected to thickness measurements at 32 sites selected at equal spaces over the whole circumference on the center line of the ribbon, using a microgauge. One selvage resulting from weaving was selected as measurement site 1, and the other selvage as measurement site 17.

The results of thickness measurements in Example 6 and Comparative Example 3 were as follows, the unit being mm.

Standard Ribbon

Comparative Example 3

In the order of site 1 to site 32: 0.128, 0.111, 0.114, 0.113, 0.113, 0.112, 0.113, 0.114, 0.111, 0.113, 0.113, 0.112, 0.114, 0.114, 0.114, 0.112, 0.124, 0.112, 0.113, 0.114, 0.112, 0.115, 0.114, 0.113, 0.114, 0.113, 0.114, 0.114, 0.113, 0.113, 0.110 and 0.112. The thickness at site 1 is 0.128, and that at site 17 is 0.124. The simple arithmetic mean of the 32 sites is 0.114, and the mean of 30 sites excluding sites 1 and 17 is 0.113.

Statically Hot-Pressed Ribbon

Example 6

In the order of site 1 to site 32: 0.107, 0.101, 0.097, 0.100, 0.100, 0.098, 0.100, 0.101, 0.098, 0.097, 0.096, 0.097, 0.098, 0.099, 0.100, 0.099, 0.106, 0.099, 0.098, 0.097, 0.097, 0.096, 0.101, 0.101, 0.099, 0.099, 0.100, 0.101, 0.099, 0.100, 0.100 and 0.100. The thickness at site 1 is 0.107, and that at site 17 is 0.106. The simple arithmetic mean of the 32 sites is 0.099, and the mean of 30 sites excluding sites 1 and 17 is 0.099.

Comparison

In Comparative Example 3, the difference between maximum and minimum is 0.128−0.110=0.018 mm, the maximum being greater by 0.015 mm than the mean (0.113 mm) of 30 sites excluding sites 1 and 17. On the other hand, in Example 6, the difference between maximum and minimum is 0.107−0.096=0.011 mm, the maximum being greater by 0.008 mm than the mean (0.099 mm) of 30 sites excluding sites 1 and 17. These data indicate that, in Example 6, which is concerned with a statically hot-pressed product, the difference between the selvage portions and remaining regions is reduced and the thickness is more uniform around the whole circumference of the ribbon.

As already mentioned hereinabove, the seamless ink ribbon of the present invention has a largely reduced thickness (and a smoother surface as well) while retaining the strength and therefore can be loaded, with a longer circumferential length, into the limited cassette space. Owing to the reduced thickness (and improved surface condition) coupled with the increased circumferential length, the contact between the ink ribbon surface and paper can be reduced. As a result, even when rough-surfaced paper such as paper made in China is used, the printing capacity of the ribbon can be increased, for example about 1.3 to 1.8 times as compared with the conventional seamless ink ribbons having the same yarn density. When ordinary paper is used, the printing capacity can be increased as compared with the conventional ink ribbons as well.

Further, since the static hot pressing technique is employed in accordance with the present invention, no shearing force is exerted, unlike the case of hot pressing while rotating rolls, hence no texture disturbance or wrinkling will occur. In addition, while seamless woven fabrics inevitably have both selvage regions somewhat thicker than the remaining regions as resulting from weaving, the static hot pressing according to the present invention markedly reduces the difference in thickness between the selvage portions resulting from weaving and the remaining regions, whereby a uniform thickness is attained around the whole circumference of the ribbon, giving a further advantage in that the ribbon running and/or printing operation becomes smoother.

What is claimed is:

1. A method of manufacturing a seamless woven ink printing ribbon comprising the steps of subjecting a seamless woven fabric obtained by double weaving multifilament yarn as warp and as weft to static hot pressing, without applying any shearing force to said seamless fabric during said hot pressing, and during said hot pressing reducing the thickness of said fabric by not less than 15% with the upper limit of thickness reduction of not more than 50% as compared with the original thickness of said seamless fabric before pressing, and fuse-cutting said seamless fabric to ribbon width before or after said hot pressing.

2. A method as claimed in claim 1, wherein the static hot pressing without shearing force application is carried out using a flat hot press.

* * * * *